United States Patent [19]

Mori et al.

[11] 4,080,213

[45] Mar. 21, 1978

[54] SAND MOLD COMPOSITION FOR METAL CASTING

[75] Inventors: Atsuo Mori; Kozo Tsuji; Kiyohiko Nakae, all of Takatsuki, Japan

[73] Assignees: Sumitomo Chemical Company, Limited, Osaka; Hayashibara Biochemical Laboratories, Inc., Okayama, both of Japan

[21] Appl. No.: 674,237

[22] Filed: Apr. 6, 1976

[30] Foreign Application Priority Data

Apr. 11, 1975 Japan ..... 50-44479

[51] Int. Cl.[2] ..... B28B 7/34

[52] U.S. Cl. ..... 106/38.5 R; 106/38.35; 106/193 J; 106/197 C; 106/209; 106/214

[58] Field of Search ..... 106/38.5 R, 38.35, 214, 106/287 S, 193 J, 197 C, 209

[56] References Cited

U.S. PATENT DOCUMENTS

| | | | |
|---|---|---|---|
| 2,977,236 | 3/1961 | Neukom | 106/214 |
| 3,179,523 | 4/1965 | Moren | 106/38.35 |

OTHER PUBLICATIONS

Hijiya et al., Chem. Abs., vol. 82, 1975, 18915e, 58849t.

*Primary Examiner*—Lorenzo B. Hayes

*Attorney, Agent, or Firm*—Stevens, Davis, Miller & Mosher

[57] ABSTRACT

A sand mold composition for the metal casting comprising a molding sand and pullulan as a binder therefor. As compared with prior art, the present composition has following advantages: in the molding step, no gas, dust, noise, or vibration is generated; in the pouring and sand stripping steps, neither noxious gas nor offensive odor is emitted; although the mold has a sufficiently high strength at room temperature for the convenient handling, it is readily broken down after the casting and so renders the knock-out and sand stripping very easy; and the recovered sand can be reused as such, practically without any after-treatment. The molding cycle is comparable to that of conventional oil sand or carbon dioxide-bonded mold.

9 Claims, No Drawings

SAND MOLD COMPOSITION FOR METAL CASTING

This invention relates to a sand mold composition for casting metals comprising a molding sand and pullulan as a binder therefor.

In preparing a sand mold and a core mold, there have heretofore been employed for the binder of the sand various materials which are broadly classified into organic binders and inorganic binders. The organic binders include polysaccharides such as starch, modified starch, grain meals, cane sugar, and cellulose derivatives; drying oils such as linseed oil, soybean oil, tung oil, sardine oil, and whale oil; and synthetic resins such as polyvinyl alcohol, polyacrylic acid, phenolic resin, urea resin, furan resin, polyisocyanate resins, alkyd resins, and polystyrene. Inorganic binders include clays such as kaolinite and bentonite; water glass, cement, gypsum, and ethyl silicate. Each of these binder materials, however, has merits and demerits and none of them fully answers the performance requirements for metal casting.

For instance, starch, grain meals, and cane sugar, which have long been known as binder materials, increase wet strength of a green sand mold but not sufficiently enough if used alone in normal amounts. These materials are now employed only as additives or secondary binders, similarly to powdered coal or wood flour; they are now scarcely used as primary binders, because even if the green mold is heat treated, the resulting dry mold will show markedly crumbly surface and low strength.

The drying oils such as linseed oil and the like, although now widely used in a core mold called "oil core", have disadvantages of generating a strongly offensive odor owing to a high temperature at which the oil core is hardened by oxidation and of generating also a noxious gas of offensive odor in the pouring step, thus spoiling the working environment and, in recent years, becoming one of the sources of public hazards. Therefore, an improved binder is strongly demanded from the metal casting industry.

The phenolic resins have been widely used particularly in the so-called "shell mold process" which has advantages of rapid curing and high strength of the mold and desirable casting surface. Therefore, phenolic resins are often used as essential materials for the mass production of metal castings and the high speed casting cycle. However, phenolic resins have disadvantages of generating a noxious gas of offensive odors such as ammonia, formaldehyde, carbon monoxide, phenol and the like in the processing of resincoated sand, the processing of mold, and the pouring of molten metal, thus spoiling the working environment and becoming one of the sources of public pollution with offensive odors. Therefore, in recent years, the improvement therefor is strongly demanded from the metal casting industry. Many of other organic binders also have disadvantages as mentioned above.

The inorganic clay binders, on the other hand, generate relatively small amounts of malodorous gases, but have other disadvantages.

For instance, although the molds prepared by use of clays are of relatively good quality, they have disadvantages in that the mold tends to crack during drying and the dry mold has poor collapsibility, resulting in crack formation in the cast metal. In order to overcome the difficulties, clays are now being used jointly with additives such as powdered coal and grain meals. Such additives, however, emit irritating malodorous gases and dusts which spoil the working environment. The vibration and noise arisen from ramming and pressing operations can cause public nuisance.

Water glass is widely used in preparing so-called "carbon dioxide molds" which are inexpensive, scarcely show the gas defects such as blow-holes, as are often the case with organic binders, and have favorable collapsibility. Water glass, however, has disadvantages in that it causes erosion and, hence, sintering of the sand at high temperatures, thus rendering difficult both the sand stripping and the sand recovery. Moreover, the waste sand shows some alkalinity and so cannot be easily discarded.

The cement-bonded molds have advantages of low cost and high strength. However, their disadvantages are long hardening time, short shelf life, poor collapsibility, and impossibility of sand recovery.

Generally, as mentioned above, advantages of the organic binder are easy sand stripping and easy recovery and reuse of the sand, whereas their disadvantages are the emission of noxious and malodorous gases due to thermal decomposition and the tendency to cause gas defects. In the case of inorganic binders, although there is little danger of gas evolution, the sand stripping is difficult to perform and the recovery and reuse of the sand are also difficult.

As described in the foregoing, among the performance characteristics required for the casting mold, which vary in a broad range, recent chief concerns are directed particularly to control pollutants and public nuisance such as noxious and malodorous gases, dusts, noise, and vibration and to recover the sand for reuse in view of the situation of resources. Other customary performance characteristics are of course required. However, there has been known no casting mold capable of meeting all of the requirements.

As a result of extensive studies conducted to find a way to answer as far as possible the required performance characteristics of the mold, the present inventors have found a novel casting sand mold composition which emits no pollutant such as malodorous or noxious gas, yields a cast article easily strippable of the mold sand, and permits easy recovery and reuse of the sand.

An object of the present invention is to provide a sand mold composition for metal casting comprising a molding sand and pullulan as a binder therefor.

Other objects and advantages of this invention will become apparent from the following description. As compared with prior art, the present composition has following advantages: in the molding step, no gas, dust, noise or vibration is generated; in the pouring of molten metal and sand stripping, neither noxious gas nor offensive odor is emitted; although the mold has a sufficiently high strength for the convenient handling at room temperature, it is readily broken down after the casting and renders the knock-out and sand stripping very easy; and the recovered sand can be reused as such with little after-treatment. The molding cycle is comparable to that of conventional oil sand or carbon dioxide-bonded mold.

The invention is further described below in detail.

The molding sand for use in this invention may be any of the types customarily used in the casting industry, but is preferably a type of nearly pure washed sand having round or obtuse edges, particularly a type specified in JIS G No. 5901-1954. Generally, a silica sand of uniform particle size is preferred from the view point of permeability to gases whereas that of multiple particle sizes containing fine particles is preferred in view of mold strength. However, when pullulan is used according to this invention, any type of molding sand may yield a high-strength sand mold. Consequently, limiting factors for the selection of sand are the kind and temperature of the metal to be poured into the mold and the smoothness of casting surface required for the intended product. It is desirable, therefore, to select a suitable type of sand under consideration of these factors. It seems a general tendency of the casting industry to select a type of sand of fine particle size to improve smoothness of the casting surface, so long as the selected sand may yield a mold of necessary permeability. The selection of sand conforming to this general tendency is of course desirable in the case of the present invention. For special purposes, combined use of the molding sand with fire clays and other clays such as, for example, bentonite is sometimes advantageous.

The pullulan used as binder in this invention is a high-molecular-weight linear polymer in which recurring structural units of maltotriose, a trimer of glucose, are joined to one another through $\alpha$-1,6 linkages, which are different from the linkages through which glucose units are joined to form said maltotriose unit, thus leading to a molecular structure represented by the following formula:

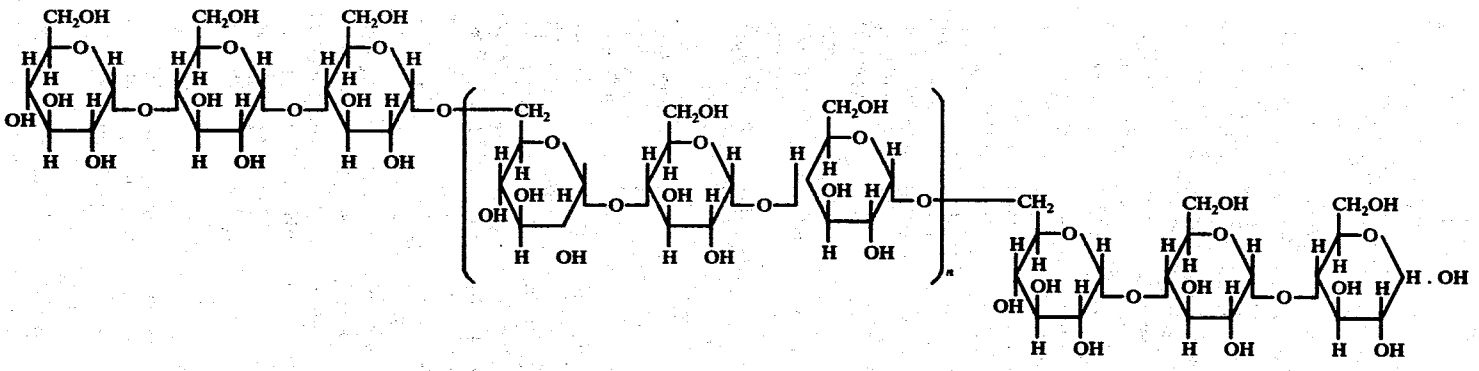

wherein $n$ is an integer representing the polymerization degree of 8 to 10,000. Pullulan may be synthesized chemically or biochemically.

The method for producing pullulan used in this invention is not critical. As an example, mention is made below of a method in which pullulan is isolated and recovered as an extracellular tacky substance by culturing a strain belonging to the genus *Pullularia* which is an incomplete microorganism [H. Bender, J. Lehmann et al., Biochem. Biophys. Acta, 36, 309 (1954); Seinosuke Ueda, Journal of the Chemical Society of Japan, Industrial Section, 67, 757 (1964)].

A strain of *Pullularia pullulans* is inoculated into a culture medium comprising 10% of starch syrup or glucose, 0.5% of $K_2HPO_4$, 0.1% of NaCl, 0.02% of $MgSO_4 \cdot 7H_2O$, 0.06% of $(NH_4)_2SO_4$, and 0.04% of yeast extract and cultured with shaking at 24° C. for 5 days. After removal of cells by centrifugation, the pullulan produced as an extracellular tacky substance is precipitated by addition of methanol. The precipitate is repeatedly dissolved in water and precipitated with methanol to isolate white pullulan which was further washed with methanol and dried to obtain dry pullulan in a yield of 60 to 70% based on the saccharides.

Physical properties of pullulan have never been examined and have remained practically unknown, except that it is a tacky substance soluble in water. Until quite recently, there have been no report on the use of pullulan. Pullulan, therefore, is substantially a new substance in the field of sand mold binder.

During the reserch work on physical properties of pullulan, the present inventors have found that pullulan generates neither malodorous nor noxious gases on thermal decomposition at high temperatures and that it has desirable affinity to inorganic substances and also has a property to bind inorganic powder particles together in a favorable way. The present inventors conducted further research on application of pullulan to the sand mold, thus resulting in accomplishment of this invention.

Among the known binders and additives for sand mold, there are substances which are derivatives based on glucose, such as starch, oxidized starch, enzymated starch, etherized starch, cationized starch, aminated starch, dextrin, methylcellulose, carboxymethylcellulose, hydroxyethylcellulose, sodium alginate, acacia, etc., and derivatives thereof. However, they are entirely different from pullulan in chemical structure and, hence, in properties. For instance, pullulan is easily soluble in cold water and the resulting aqueous solution is stable for a long period of time without showing gelation or "aging" phenomenon. This property is quite different from that of starch derivatives. Further, the results of experiments carried out to accomplish this invention showed that the ability of pullulan to bind a powdered inorganic substance into a sand mold was markedly better than that of starch derivatives.

Although the molecular weight of pullulan for use in the present invention is subject to no particular restriction, it is preferably 5,000 to 2,000,000, more preferably 5,000 to 1,000,000, because if the molecular weight is less than 5,000, the binding strength becomes low and an increased amount of pullulan must be added to the molding sand and if the molecular weight is more than 2,000,000, the aqueous solution of pullulan becomes too viscous to handle in the mixing and the molding steps.

The proportion of pullulan to be added to the molding sand may vary in a broad range. It is necessary to select the proportion properly depending upon the use of the mold and the particle size of the molding sand, so that the desired mold stregnth may be obtained. For instance, pullulan in an amount as small as 0.1 part by weight based on dry molding sand may be sufficient for forming a satisfactory sand mold for a certain purpose, whereas an amount as large as 5 parts by weight or more may be used for another purpose. An amount of pullulan less than 0.1 part by weight for 100 parts by weight of the molding sand is undesirable, because pullulan in such a small amount is unable to perform the function of a primary binder and, hence, the resulting sand mold becomes unsatisfactory in strength for ordinary purposes. On the other hand, incorporation of pullulan in excessive amounts exceeding 15 parts by weight is apt to cause defective casting due to the gases evolved in the pouring of molten metal and, moreover, is an economical waste, because practically a necessary strength is attainable by incorporating 0.1 to 15, preferably 0.5 to 8, most preferably 0.5 to 3 parts by weight of pullulan in 100 parts by weight of the dry molding sand.

Beside molding sand and pullulan as binder, a necessary ingredient of the present sand mold composition is water. Water is required generally for the purpose of imparting to the molding sand mixture both plasticity and green strength which are necessary for forming the sand mold. Satisfactory green strength and plasticity are obtained when the water content of the composition is in the range of 0.5 to 15% by weight on dry mixture of molding sand and binders. In case the sand mold is used as a green sand mold, a water content within the above range is suitable. Since water vapor generated in the pouring step might adversely affect the casting, it is desirable to incorporate water in an amount as small as possible. It is generally preferred to use a sand mold as a dry mold. If this is the case, an excessively large water content results unduly prolonged drying period, whereas too small a water content brings about an insufficient green strength, resulting in difficult molding. A desirable water content of the composition for dry mold is in the range of 0.5 to 10%, preferably 1 to 6%.

In order to further improve the plasticity and workability, it is possible to use pullulan jointly with plasticizers for pullulan such as ethyleneglycol, propylene glycol, glycerol, and other polyhydric alcohols and customary additives such as, for example, clays, starches, starch derivatives, sodium alginate, carboxymethylcellulose, methylcellulose, hydroxyethylcellulose, acacia, and derivatives thereof, so long as no offensive odor is emitted and physical properties required for the mold are not injured. For the same purposes, it is also possible to use partially modified pullulan such as etherified, esterified, oxidized, or aminated pullulan each alone of jointly with pullulan so long as the physical properties required for the mold are not injured.

In order to improve release property, it is possible to incorporate oily materials such as kerosine, gas oil, and silicone oil, so long as malodorous gases are not generated and the physical properties required for the mold are not injured.

In actual practice according to this invention, dry molding sand and pullulan may be mixed in customary ways. Powdered pullulan and dried molding sand are mixed to form a stock mixture which, before use, is admixed with a suitable amount of water to form the present composition. Since pullulan is a very stable compound, the dry stock mixture can be kept without degradation for a long period of time. Alternatively, since pullulan is readily soluble even in cold water, it is possible to prepare an aqueous pullulan solution in advance and the solution is then mixed with dried sand to form the present composition. The latter method is preferred, because pullulan is produced in the form of 5 to 20 % aqueous solution. It is most convenient to use an aqueous pullulan solution prepared by diluting or concentrating the original pullulan solution so that the resulting molding sand composition may contain proper amounts of total water and pullulan. A crude culture broth containing cells may also be used as such without having been subjected to purification treatments such as removal of cells and precipitation with methanol in the process for producing pullulan. It is also possible to mix dry pullulan with wet molding sand.

Mixing of the molding sand and pullulan may be carried out by hand or, more easily, by use of a sand mill such as Simpson mill, speed muller, or whirl mixer. For instance, an aqueous solution is added to the molding sand agitated in a whirl mixer to form a uniform green composition in 1 to 5 minutes. The resulting green composition may be stored until it is used for molding. If water was lost during storage, it is easily replenished at the moment of use.

The sand mold may be formed in any way by use of the present composition. Any customary molding method can be applied to the present composition. Examples of such methods are bench molding and machine molding. Any of the patterns such as metallic, wooden, and plastic patterns may be used.

When the green sand mold prepared as mentioned above is stored, its strength is increased spontaneously owing to vaporization of the water into the air. Such natural air drying, however, requires a long time. The drying time may be cut short by hot air drying, dielectric heating, or vacuum drying. A suitable drying temperature is 70° to 300° C., preferably 100° to 200° C. if possible. The drying time is from 5 to 60 minutes, usually 5 to 30 minutes being sufficient. Compared with the conventional oil sand mold process which requires a drying time of 2 hours at a temperature of 200° C. or higher, the present composition can be molded at a lower temperature and in a shorter period of time, resulting in saving of the fuel cost and speedy molding cycle.

The dry sand mold of this invention has excellent strength and hardness and may be handled quite easily. Moreover, since pullulan has a characteristic property of markedly decreasing in its water absorption once dried at 100° C. or higher temperatures, the present sand mold dried at a temperature of 100° C. or higher is hardly subject to deterioration due to moisture absorption during indoor storage.

When casting is carried out by use of the present dry sand mold obtained as mentioned above, the mold retains sufficient strength throughout the pouring period, whereas the pullulan in the mold begins to decompose gradually as the metal is cooled to the solidification point and the decomposition is complete after the solidified metal has been further cooled and become ready to be stripped of sand. Consequently, sand stripping is very easily performed and the recovered sand can be reused substantially without any after treatment. In these respects, the present mold is far superior to the conventional carbon dioxide mold.

The odor generated in the pouring step is very scarce and, in addition, is not disagreeable. In this respect, the present sand mold is superior to the convention oil sand mold.

The invention is illustrated below with reference to Examples, but the invention is not limited thereto.

EXAMPLE 1

A 20-% aqueous solution of pullulan having a molecular weight of 38,000, 150,000, 185,000, or 370,000 was added to Yayoi No. 6 silica sand ($SiO_2$: 94 wt%, $Al_2O_3$: 3.2 wt%, $Fe_2O_3$: 1.4 wt%, CaO: 0.8 wt%, MgO: 0.2 wt%, unknown material: 0.4 wt%) so that pullulan content of the resulting mixture might become 1 % based on the sand. The mixture was milled for 3 minutes in a sand mill and test specimens, 10 × 10 × 60 mm, as specified in JIS Z 2604-1960, were prepared from the milled mixture. The test specimens were dried in an explosion-proof constant temperature dryer (type 50S-S4A made by Satake Seisakusho Co.) at 150° C. for 15 minutes, left standing until cooled to room temperature, and tested for flexural strength (hereinafter referred to as dry flexural strength). The results obtained were as shown in Table 1. For comparison, in Table 1 are also shown the results of tests for flexural strength of the test specimens prepared in a manner similar to that mentioned above by using wheat starch, potatostarch, cornstarch, pregelatinized starch, dextrin, carboxymethylcellulose, sodium alginate, hydroxyethylcellulose, methylhydroxyethylcellulose (all of the substances listed above were reagents manufactured by Nakarai Chemicals Co.), polyvinyl alcohol (Gosenol® NH 26), or polyacrylic acid (a reagent manufactured by Nakarai Chemicals Co.).

In Table 1 are further shown the results of organoleptic test conducted on the gases generated on heating each binder at 500° C.

It is seen from Table 1 that as compared with other water-soluble polymers, pullulan gives a markedly high strength and, in addition, emits no objectionable or disagreeable odor on thermal decomposition.

Table 1

| Polymer (mol. wt.) | Dry flexural strength ($kg/cm^2$) | Odor |
|---|---|---|
| Pullulan ( 38,000) | 30.2 | No objectionable odor; No disagreeable odor |
| Pullulan (150,000) | 33.1 | |
| Pullulan (185,000) | 40.3 | |
| Pullulan (370,000) | 45.8 | |
| Wheat starch | 20.0 | No objectionable and disagreeable odor |
| Potato starch | 9.0 | Rather strongly irritating odor |
| Cornstarch | 8.7 | No objectionable and disagreeable odor |
| Pregelatinized starch | 12.2 | |
| Dextrin | 6.3 | Strongly objectionable and disagreeable odor |
| Carboxymethylcellulose | 9.6 | Strongly irritating odor |
| Sodium alginate | 1.5 | No objectionable and disagreeable odor |
| Hydroxyethylcellulose | 21.0 | Strongly irritating methanolic odor |

Table 1-continued

| Polymer (mol. wt.) | Dry flexural strength ($kg/cm^2$) | Odor |
|---|---|---|
| Methylhydroxyethylcellulose | 21.0 | |
| Polyvinyl alcohol | 25.1 | Strongly objectionable, disagreeable, and irritating odor |
| Polyacrylic acid | 11.7 | |

Note: Yayoi No. 6 silica sand has the following grain size distribution:

| Mesh: | 28 | 35 | 48 | 65 | 100 | 150 | 200 | 270 |
|---|---|---|---|---|---|---|---|---|
| wt % | 1.0 | 3.0 | 10.6 | 41.0 | 31.2 | 10.0 | 3.0 | 0.2 |

EXAMPLE 2

A 15-% aqueous solution of pullulan having a molecular weight of 185,000 was added to Yayoi No. 6 silica sand so that pullulan content of the resulting mixture might become 1 % based on the sand. The mixture was milled for 3 minutes in a sand mill and test specimens, 20 × 20 × 60 mm, as specified in JIS Z 2604-1960, were prepared from the milled mixture. The test specimens were dried in an explosion-proof constant temperature dryer (type 50S-S4A made by Satake Seisakusho Co.) at prescribed temperatures for various periods of time and tested for moisture content and flexural strength. The results obtained were as shown in Table 2.

Table 2

| Drying temperature | 120° C | | | | | | 200° C | | | |
|---|---|---|---|---|---|---|---|---|---|---|
| Test item / Drying time | 3 min. | 6 min. | 10 min. | 20 min. | 30 min. | 40 min. | 3 min. | 6 min. | 10 min. | 20 min. |
| Moisture content (%) | 3.7 | 2.6 | 1.6 | 0.3 | 0.02 | 0.01 | 1.1 | 0.02 | 0.01 | 0.01 |
| Flexural strength ($kg/cm^2$) | 3.0 | 5.7 | 11.3 | 30.4 | 40.5 | 39.8 | 10.7 | 35.0 | 39.7 | 40.5 |

Note:
1. The initial moisture content was 5.6%
2. The moisture content was calculated by the equation,
Moisture content (%) = (moisture/dry material) × 100.

For comparison, 93 % of Yayoi No. 6 silica sand, 2.2 % of bentonite clay, 1.5 % of dextrin, and 3.3 % of linseed oil were mixed and milled in a whirl mixer. The resulting oil sand was tested in a manner similar to that mentioned above. The results obtained were as shown in Table 3.

Table 3

| Curing time (minute) | 30 | 60 | 90 | 120 |
|---|---|---|---|---|
| Flexural strength ($kg/cm^2$) | 8.0 | 15.5 | 21.3 | 28.0 |

Note: Curing temperature was 200° C

It is seen from Tables 2 and 3 that as compared with the oil sand mold, the present mold can be dried in markedly shorter period of time.

EXAMPLE 3

Yayoi No. 6 silica sand, bentonite clay, and pullulan (molecular weight 185,000) were mixed according to the formulation given in Table 4 and milled for 2 minutes in a whirl mixer. Test specimens, 50 $\phi$ × 50 mm and 10 × 10 × 60 mm, as specified in JIS Z 2604-1960, were prepared from the above molding sand and tested for green compressive strength and dry flexural strength. The results obtained were as shown in Table 4.

Table 4

| | | | | | | |
|---|---|---|---|---|---|---|
| Formulation (Parts by weight) | Yayoi No. 6 silica sand | 99 | 98 | 97 | 96 | 94 |
| | Bentonite clay | 0 | 1 | 2 | 3 | 5 |
| | Pullulan | 1 | 1 | 1 | 1 | 1 |
| | Water content (%) | 4.5 | 6.0 | 6.0 | 6.0 | 6.0 |
| Green compressive strength ($kg/cm^2$) | | 0.17 | 0.19 | 0.23 | 0.29 | 0.36 |
| Dry flexural strength ($kg/cm^2$) | | 40.3 | 38.0 | 35.4 | 30.0 | 20.1 |

Note: Test specimens for testing dry flexural strength were dried under the same conditions as in Example 1.

It is seen from Table 4 that incorporation of bentonite is effective for improving the green strength.

EXAMPLE 4

To 60 kg of Yayoi No. 6 silica sand agitated in a whirl mixer (operating at 76 rpm), was added 3.03 kg of a 20-% aqueous solution of pullulan having a molecular weight of 185,000. The resulting mixture was milled for about 1.5 minutes. No odor was detected. In this respect, the present composition was far superior to the shell mold and the furan-base self-curing mold. The resulting molding sand (referred to as molding sand A) has a moisture content of about 3.9 %. This molding sand was bench-molded in a socket clevis pattern. After having been released of the pattern, the sand mold was dried in an explosion-proof constant temperature dryer (type 50S-S4A made by Satake Seisakusho Co.) at 200° C. for 30 minutes to obtain a dry mold of a moisture content of 0.02 %.

In another experimental run, 60 kg of Yayoi No. 6 silica sand and 1.875 kg of bentonite were mixed in a whirl mixer for 15 seconds. To the mixture was added 3.125 kg of a 20-% aqueous solution of pullulan having a molecular weight of 185,000 and the mixture was milled for about 1.5 minutes. The resulting molding sand (referred to as molding sand B) had a moisture content of about 4.0 %. This sand was molded in a socket clevis pattern in the same manner as mentioned in the case of the molding sand A.

Two master molds were prepared from the molding sand B by use of a ramming machine. The socket clevis cores prepared from the molding sand A and B were set respectively in each master mold and pouring experiments were run. The pouring temperature of malleable cast iron was 1450° C. and the pouring time was 15 seconds. During the pouring, almost no odor was detected, except for a faint smell suggestive of scorched sweet potato. In this respect, the present core had distinctive superiority over the shell mold core or oil sand core. After the metal had been left standing to cool, knock-out behavior of the core was examined. Both cores made from molding sand A and B were broken down almost spontaneously, exhibiting very favorable knock-out behaviour. In this respect, the present mold was far preferable to the water-glass-base mold. The castings obtained were of high quality without showing no casting defect.

What is claimed is:

1. A sand mold composition for the metal casting comprising a molding sand and pullulan having a molecular weight of 5000 to 2,000,000 as a binder therefor, said pullulan being present in a quantity of 0.1 to 15 parts by weight of pullulan for every 100 parts by weight of molding sand.

2. A composition according to claim 1, wherein the molding sand is silica sand.

3. A composition according to claim 1, wherein moisture content of the composition is 0.5 to 15% by weight based on dry composition.

4. A composition according to claim 1, wherein clay is incorporated in the composition.

5. A composition according to claim 4, wherein the clay is bentonite.

6. A composition according to claim 1, wherein at least one of the ethylene glycol, propylene glycol, glycerol, starch, sodium alginate, carboxymethylcellulose, methylcellulose, hydroxyethylcellulose, acacia, and derivatives thereof is added as a plasticizer for pullulan.

7. A composition according to claim 1, wherein an etherified, esterififed, oxidized, or aminated pullulan is used jointly with or in place of pullulan.

8. A composition according to claim 1, wherein kerosene, gas oil, or silicon oil is added to the composition.

9. A sand mold for the metal casting preapred from a molding sand and pullulan having a molecular weight of 5,000 to 2,000,000 as a binder therefor, said pullulan being present in a quantity of 0.1 to 15 parts by weight of pullulan for every 100 parts by weight of molding sand.

* * * * *